US008791872B2

(12) United States Patent
Coupez

(10) Patent No.: US 8,791,872 B2
(45) Date of Patent: Jul. 29, 2014

(54) ULTRA WIDE BAND ANTENNA OR ANTENNA MEMBER

(75) Inventor: Jean-Philippe Coupez, Brest (FR)

(73) Assignee: Groupe des Ecoles des Telecommunications (ENST Bretange), Paris (FR)

( * ) Notice: Subject to any disclaimer, the term of this patent is extended or adjusted under 35 U.S.C. 154(b) by 308 days.

(21) Appl. No.: 12/524,355

(22) PCT Filed: Jan. 24, 2008

(86) PCT No.: PCT/EP2008/050830

§ 371 (c)(1),
(2), (4) Date: Jul. 23, 2009

(87) PCT Pub. No.: WO2008/090204

PCT Pub. Date: Jul. 31, 2008

(65) Prior Publication Data

US 2010/0103070 A1 Apr. 29, 2010

(30) Foreign Application Priority Data

Jan. 24, 2007 (FR) ..... 07 52852

(51) Int. Cl.
*H01Q 1/36* (2006.01)
*H01Q 1/48* (2006.01)

(52) U.S. Cl.
USPC ..... 343/846; 343/830; 343/897; 343/899

(58) Field of Classification Search
USPC ..... 343/825, 826, 828, 829, 830, 846, 848, 343/896–899
See application file for complete search history.

(56) References Cited

U.S. PATENT DOCUMENTS

| | | | | |
|---|---|---|---|---|
| 3,209,362 | A | 9/1965 | Spiegelman | |
| 3,811,127 | A * | 5/1974 | Griffee et al. | 343/705 |
| 5,467,098 | A * | 11/1995 | Bonebright | 343/767 |
| 2002/0109643 | A1 | 8/2002 | Buckles | |
| 2006/0071871 | A1 | 4/2006 | Tang et al. | |

FOREIGN PATENT DOCUMENTS

| | | | |
|---|---|---|---|
| EP | 0 766 343 | A2 | 4/1997 |
| EP | 1 542 315 | A1 | 6/2005 |
| EP | 1 583 175 | A2 | 10/2005 |
| EP | 1 653 558 | A1 | 5/2006 |
| KR | 2004 0054107 | | 6/2004 |
| WO | WO 2004/073112 | A1 | 8/2004 |

* cited by examiner

*Primary Examiner* — Michael C Wimer

(74) *Attorney, Agent, or Firm* — Blakely Sokoloff Taylor & Zafman

(57) ABSTRACT

The invention relates to an omni-directional ultra-wide band antenna including at least two metallic members (14, 15, 16) provided opposite an earth plane (11) and distributed about a symmetry axis (AA) perpendicular to the earth plane (11) and at the centre of the antenna, characterised in that the metallic members (14-16) each have a narrow quasi punctual geometry at their base that flares along the symmetry axis (BB) of said metallic members (14-16) in the direction of the upper end thereof, and in that said metallic members (14-16) are oriented in a direction extending from a common point (18) of said metallic members and opposite the earth plane (11).

10 Claims, 4 Drawing Sheets

ULTRA WIDE BAND ANTENNA OR ANTENNA MEMBER

This is a non-provisional application claiming the benefit of International application number PCT/EP2008/050830 filed Jan. 24, 2008.

TECHNICAL FIELD OF THE INVENTION

The present invention concerns ultra-wide band monopole antennas or elements of antennas having an omni-directional radiation in a plane perpendicular to a central symmetry axis of the antenna.

The invention is in particular applicable in the field of ultra-wide band radio.

BACKGROUND OF THE INVENTION

The development of mobile radio applications and the development of new telecommunications standards involve increasingly high data transmission speeds.

Currently, the ultra-wide band technology targeting applications in the band between 3.1 GHz and 10.6 GHz is a good candidate for proposing high speeds.

In the framework of the development of telecommunications devices around ultra-wide band technology, dedicated antennas have been developed.

Other than the fact that these antennas must be ultra-wide band, they must also have an omni-directional radiation offering good coverage and good performance, i.e. among other things maintain stability in their performance (directivity, gain, etc.).

Also known are ultra-wide band monopole antennas, in particular planar.

Although these antennas make it possible to cover a large band, their omni-directional nature deteriorates when the frequency increases, which therefore limits their use when the objective is to obtain increasingly high speeds.

In order to improve the omni-directional nature of the ultra-wide band antennas, new structures have recently been developed.

However, although they are high-performance, these antennas remain complex and costly to implement and do not always meet the desired omni-directional radiation constraints.

PRESENTATION OF THE INVENTION

The invention proposes an ultra-wide band monopole antenna or antenna element structure having an omni-directional radiation, and which can be produced simply and inexpensively.

It therefore proposes an omni-directional ultra-wide band antenna comprising at least two metallic members arranged opposite an earth plane and distributed around a symmetry axis perpendicular to the earth plane and at the center of the antenna.

The antenna of the invention is characterized in that the metallic members each have a narrow quasi-punctual geometry at their base that flares along a symmetry axis of said metallic members toward their upper end and in that the metallic members are oriented in a direction extending from a common point (18) of said metallic members and opposite the earth plane.

The invention also concerns telecommunications devices comprising at least one such ultra-wide band monopole antenna.

It also proposes a method for manufacturing an omni-directional ultra-wide band monopole antenna comprising at least two metallic members characterized in that the metallic members are cut out of one piece in a same metal sheet.

BRIEF DESCRIPTION OF THE DRAWINGS

Other characteristics and advantages of the invention will also emerge from the purely illustrative and non-limiting description which follows and should be read with regard to the appended drawings in which.

DESCRIPTION OF ONE OR SEVERAL EMBODIMENTS AND IMPLEMENTATIONS

Structure

Figure 1:
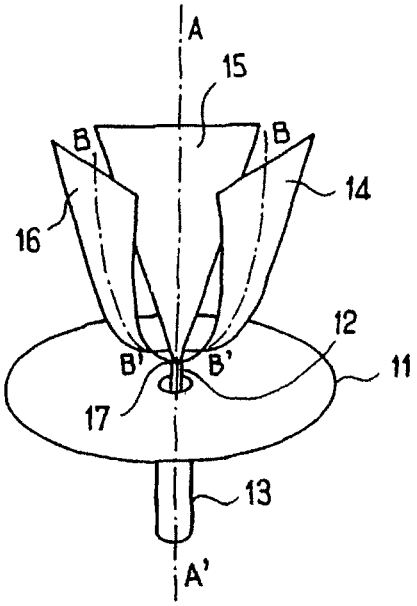
FIG. 1 illustrates the structure of a three-branch antenna.

FIG. 1 shows an example of an omni-directional ultra-wide band monopole antenna comprising three metallic members 14, 15 and 16, which we will call branches in the continuation of the description.

In general, the antenna of the invention comprises n branches, where n is greater than or equal to two.

The branches of the antenna are distributed regularly around a symmetry axis AA' at the center of the antenna. It should be noted that the branches constitute a monopole.

The branches are arranged opposite an earth plane 11. The symmetry axis AA' of the antenna is perpendicular to the earth plane 11.

The branches of the antenna are oriented in a direction opposite the position of the earth plane 11 according to a certain profile.

Figure 2:
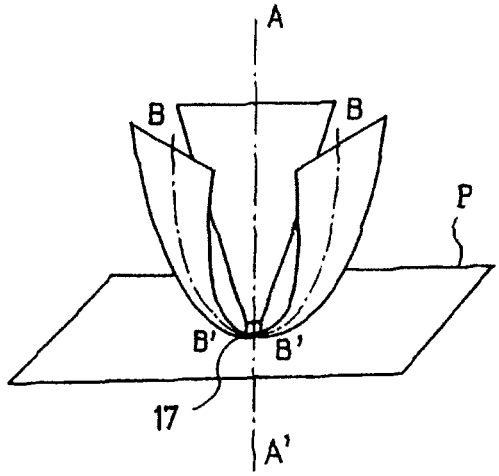
FIG. 2 illustrates a three-branch antenna element.

More generally, the branches of the antenna are oriented in a direction extending from a point 17 of the plane P shared by said metallic members and opposite this plane P, the latter being perpendicular to the symmetry axis AA' of the antenna, as illustrated in FIG. 2.

The branches are fed via a coaxial probe 12 connected at a point 17, common to all of the branches, located at the base thereof. The external conductor 13 of the probe 12 is connected to the earth plane 11.

The branches have an identical geometry and profiles and have a symmetry axis BB'.

The branches also have the particularity of having a very narrow quasi-punctual geometry at their base, i.e. their lower end (connected to the launch probe 12), and a much more flared geometry at their upper end.

The branches also have a three-dimensional profile due to the curvature given to them.

They have a given curvature, on one hand, along their longitudinal axis BB' and, on the other hand, along the direction transverse to the axis BB'.

In the example of FIG. 1, the branches 14, 15 and 16 of the antenna correspond to triangular geometric patterns, with a longitudinal profile curved in the direction opposite that of the earth plane (or more generally in the direction opposite that of the plane P).

The antenna as described offers many possibilities as to the definition of its structure.

It is in particular possible to choose the number of branches of the antenna, their duty cycle, in particular their geometry and profiles (longitudinal and transverse), their physical dimensions, as well as the distribution of the branches around the symmetry axis AA' of the antenna.

Figure 3:
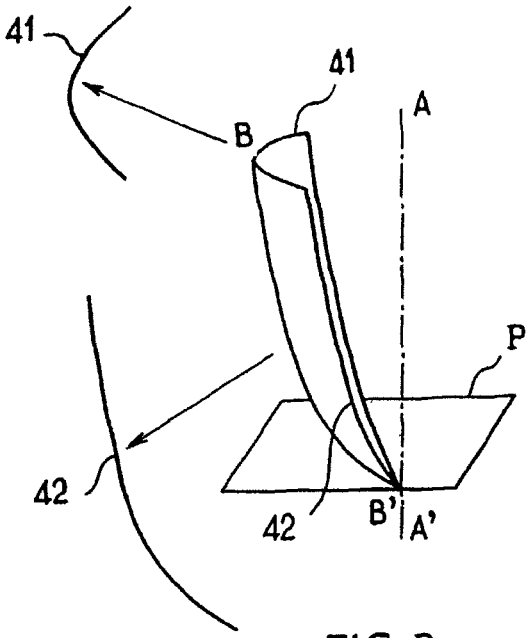
FIG. 3 illustrates an example of a branch having a non-rectilinear longitudinal and transverse profile.

FIG. 3 illustrates a branch oriented in the direction opposite the plane P. In this figure the branch has a non-rectilinear longitudinal profile 42 and a non-rectilinear transverse profile 41; these profiles can also be rectilinear.

The longitudinal profile of a branch refers to the section of the branch along a plane containing the axes BB' and AA', and transverse profile of a branch refers to the section of the branch by a plane perpendicular to the axis AA'.

Non-limitingly, FIG. 4 illustrates several possible examples of patterns (or surfaces) one can give the branches.

The geometry of the branches is flared in relation to the symmetry axis BB'.

Figure 4A:
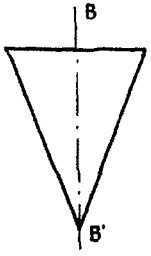
FIG. 4 illustrates several examples of patterns for the antenna branches.

In FIG. 4*a*, the branch has the shape of an isosceles triangle. The triangle can also be equilateral.

In the case of FIG. 4*a*, the branch flares in the direction of the base of the triangle. The height of the triangle is the symmetry axis BB' of the branch.

Figure 4B:
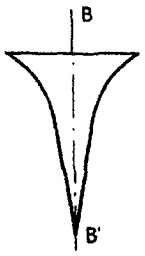

In FIG. 4*b*, the branch has a pattern of concave edges in relation to the symmetry axis B' of the branch.

Figure 4C:
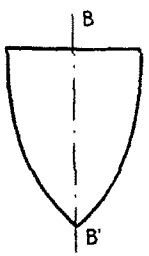
Figure 4D:
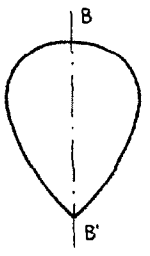

In FIGS. 4*c* and 4*d*, the branch has a pattern with convex edges in relation to the symmetry axis BB' of the branch.

Figure 4E:
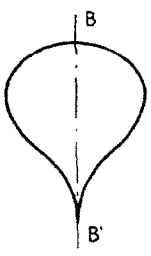

In FIG. 4*e*, the branch has a pattern with wavy edges in relation to the symmetry axis BB' of the branch.

In the patterns of the branches of FIG. 4, it should be noted that the upper end can be either straight, or convex or concave in relation to the lower end of the patterns.

One recalls that the lower end is the quasi-punctual portion of the branch and the upper end is the more flared portion of the branch.

Once the pattern of the branches is chosen, they are profiled so that they are positioned in the direction opposite the earth plane 11, or more generally in the direction opposite the plane P perpendicular to the symmetry axis AA' of the antenna passing through the common point of all of the branches.

Non-limitingly, FIG. 5 illustrates several possible examples regarding the longitudinal profile 42 which can be given to the branches.

Figure 5A:
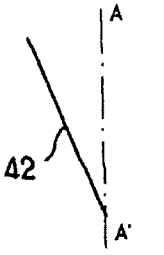
FIG. 5 illustrates several examples of profiles for the longitudinal profiles of the branches of the antenna.
Figure 5B:
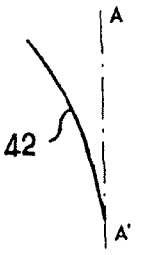
Figure 5C:
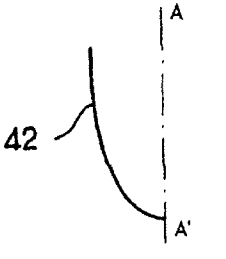
Figure 5D:
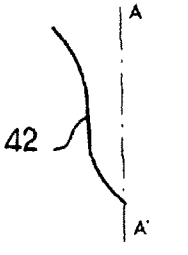
Figure 5E:
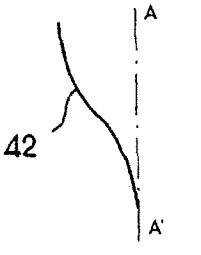

The profile 42 of FIG. 5*a* is straight, rectilinear.

The profile 42 can be concave (cf. FIG. 5*b*); the concavity can be more or less pronounced. The profile 42 can also be convex (cf. FIG. 5*c*) or wavy (cf. FIG. 5*d* or 5*e*).

These profiles have a curved appearance making it possible to favor the upward orientation of the branches of the antenna in a direction opposite the position of the earth plane 11 opposite which they will be arranged.

FIG. 6 illustrates several examples of transverse profiles 41. These are profiles seen from above.

Figure 6A:
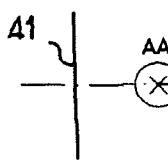
FIG. 6 illustrates several examples of profiles for the transverse profiles of the branches of the antenna.
Figure 6B:
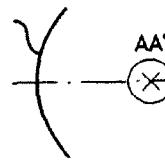
Figure 6C:
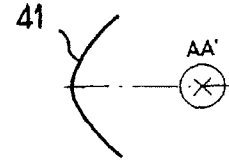
Figure 6D:
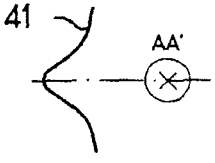
Figure 6E:
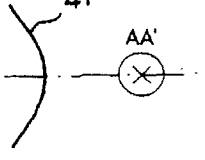

The profile of FIG. 6*a* is straight. The profile 41 can be concave (cf. FIG. 6*b* or FIG. 6*c*); the concavity can be more or less pronounced. The profile 41 can also be convex (cf. FIG. 6*e*) or wavy (cf. FIG. 6*d*).

It is through the choice of the number of branches, their duty cycle, their physical dimensions and their spatial distribution around the symmetry axis AA' of the antenna that it is possible to optimize the minimal working frequency, bandwidth, level of adaptation and look of the radiation pattern of the antenna, as well as the stability of this pattern and the related performance (directivity, gain, etc.) over the entire frequency band.

Given the applications targeted by the antenna of the invention, it is appropriate to have the widest possible bandwidth.

The wide band nature must be associated with an omni-directional radiation, in this case, in the plane perpendicular to the symmetry axis AA' of the antenna, and without dispersion of the radiation characteristics according to the frequency.

It is the physical length of the branches which conditions the minimal working frequency of the antenna.

The bandwidth depends on the geometry and profile given to the branches.

The adaptation level is also related to the criteria of geometry and profile of the branches of the antenna.

It is having branches with a very narrow, quasi-punctual geometry at the base and more flared at their end which contributes to promoting the adaptation of the antenna of the invention.

Moreover, this particular geometry also makes it possible to increase the ultra-wide band nature of the antenna.

The look of the radiation is associated in particular with the symmetry of the antenna, which is related to the distribution of the different branches around the symmetry axis AA'.

It should be noted that the greater the number of branches, the more significant the omni-directional nature of the radiation of the antenna.

Indeed, when one increases the number of branches, the structure of the antenna is that much more symmetrical.

Moreover, the diameter and length of the launch probe 12 can constitute additional adjustment means in order, in particular, to optimize the adaptation level of the antenna.

The characteristics of the earth plane opposite which the branches are arranged (its duty cycle, dimensions, for example) can also contribute to optimizing the performance of the antenna.

Production Method

The method for manufacturing the antenna must be simple in order to contribute to reducing the costs of the final antenna.

A simple and economical technical solution consists of using a metallic sheet, copper for example, in which the branches of the antenna are cut out.

The economical nature of the method for manufacturing the antenna is obtained in part due to the fact that one collectively cuts out the branches of the antenna in a single and same metallic sheet.

Figure 7:
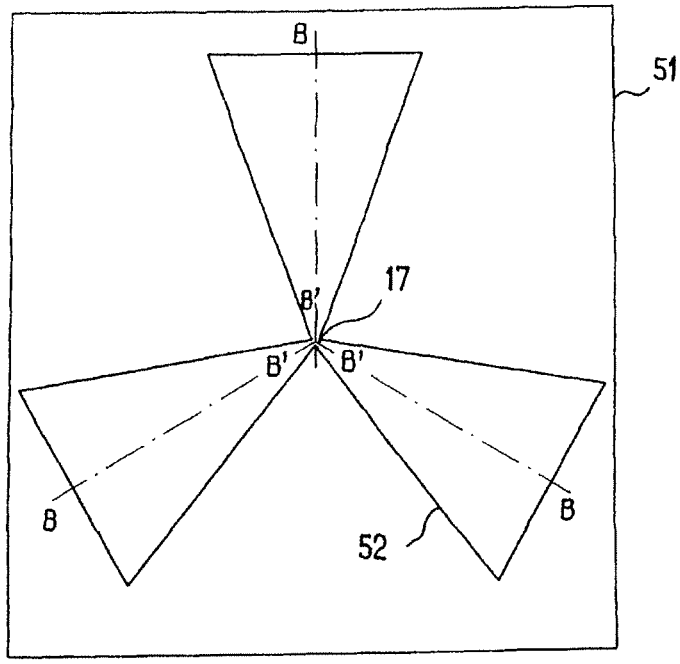
FIG. 7 illustrates an embodiment of the three-branch antenna of FIG. 1.

FIG. 7 illustrates the metallic sheet 51 in which three branches of the antenna are cut out of one piece 52.

The three branches of the antenna each have a symmetry axis BB'.

It should be noted that the location 17 of the launch probe is in a common point of all of the branches.

The thickness of the metallic sheet 51 used is very fine, up to approximately several hundreds of micrometers, for example.

Once the branches of the antenna are thus cut out, they must be profiled in order to give them the desired curvature such that they are oriented in the direction opposite that of the earth plane 11 opposite which the branches will be arranged. The different profiles given to the branches of the antenna have already been discussed (cf. FIGS. 5 and 6 in particular).

One must then connect them, using a welding spot or by sticking, to a launch probe 12, the external conductor 13 of which is connected to the earth plane 11, previously pierced, in order to allow the launch probe 12 to pass.

The earth plane 11 can assume a circular or square shape, for example. It can also be cut out in a metallic sheet. The earth plane 11 can be the case of a telecommunications box integrating the antenna as described.

The fact that the branches have a quasi-punctual geometry at their lower end facilitates the connection to the launch probe, contributing to the simplicity of production of the antenna.

As we have already mentioned, the form, in particular the geometry, profile, dimensions of the branches contribute to offering many degrees of freedom for adjusting the parameters of the antenna.

Prototype

In order to validate the antenna structure just described, several prototypes associated with different values of n have been realized and tested in adaptation.

The desired omni-directional radiation has also been verified and validated.

As an illustrative example, a four-branch antenna was in particular realized.

The branches 61 of this prototype are triangular, mounted above an earth plane 11 with a square geometry. The four branches are collectively excited by a coaxial probe 12.

Figure 8:
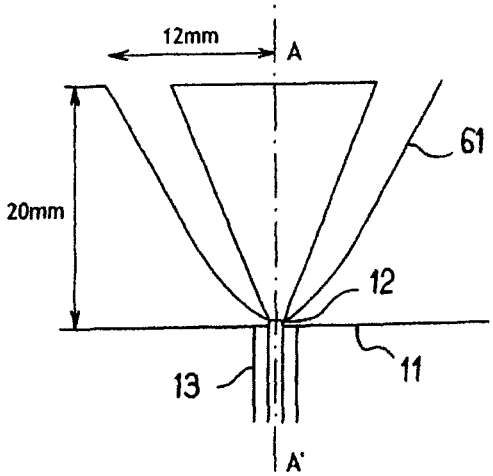
FIG. 8 illustrates the dimensioning of a four-branch antenna.

Each of the branches has the shape of an isosceles triangle with a height of 24 mm and a width of 15 mm at its upper edge; the profile of these branches is curved at the lower point of the triangle, as illustrated in FIG. 8.

The effective height of the antenna, after mounting of the monopole above the earth plane, is 20 mm. The overall volume occupied by the antenna (excluding earth plane) is therefore $24\times24\times20$ mm$^3$ in this case.

The earth plane 11 is square and planar, with dimensions $60\times60$ mm$^2$.

The feed of the antenna is done via a standard "50 ohms" coaxial connector, the central launch probe 12 of which has a diameter of 1.28 mm and a height of 1 mm.

Figure 9:
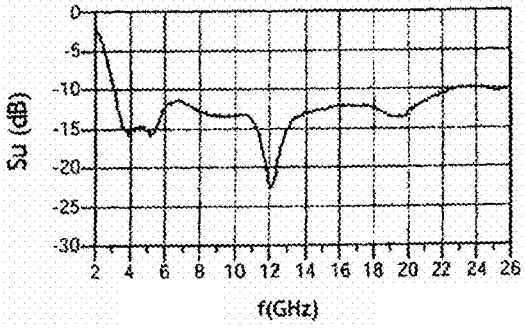
FIG. 9 illustrates the adaptive response of the four-branch antenna of FIG. 8.

FIG. 9 illustrates the adaptation response of the antenna of the invention; the reflection coefficient module $S_{11}$ is illustrated as a function of the frequency expressed in GHz. The antenna operates with a very good adaptation; the reflection coefficient module $S_{11}$ is in the vicinity of −10 dB, or less on a wide band going from 3 GHz to 26 GHz, minimum.

This also shows the ultra-wide band nature of the antenna of the invention.

The antenna was also tested in transmission through the establishment of a radio connection between two identical antennas as described, separated by a distance of 30 cm.

Figure 10:
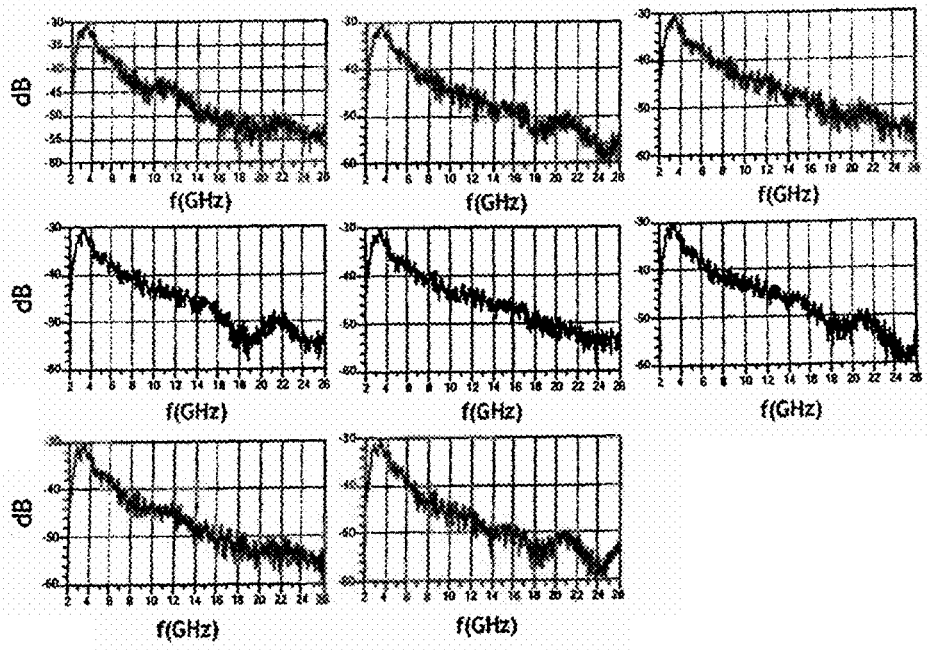
FIG. 10 illustrates the transmission responses in eight directions of the azimuth plane of the four-branch antenna of FIG. 8.

FIG. 10 illustrates the results of transmission measurements along eight directions distributed regularly in the azimuth plane (perpendicular to the symmetry axis AA' of the antenna); the reflection coefficient module is shown as a function of the frequency expressed in GHz.

For each of the tested directions, the transmission response is identical over a wide band from 3 GHz to 26 GHz, minimum.

These transmission responses indeed illustrate that in the azimuth plane, the radiation is omni-directional.

The antenna thus described has a small volume, allowing its integration into wireless telecommunications devices operating according to ultra-wide band technology.

Moreover, the different characteristics of the branches (geometry, dimension, profile) make it possible to have many possibilities regarding the different possible adjustments of the antenna contributing to their integration flexibility into telecommunications devices.

The invention claimed is:

1. An omni-directional ultra-wide band antenna comprising:

at least two metallic members (14, 15, 16) arranged symmetrically and opposite an earth plane (11), said antenna having a symmetry axis (AA') perpendicular to the earth plane (11), said metallic members being distributed around said symmetry axis (AA'), and having identical geometry and dimensions, wherein all the metallic members are connected to each other at a common point located along the symmetry axis of said antenna, said common point being connected to a launch probe forming feed means;

wherein each metallic member (14-16) has a symmetry axis (BB'), a geometry, a base and an upper end opposite to the earth plane (11), wherein each of the metallic members (14, 15, 16) has a surface chosen among the following group: triangular, with concave edges or wavy edges, triangular with convex or wavy edges in relation to the symmetry axis (BB')of said metallic members, wherein said geometry forms a point at its base that connects to the common point and widens from the common point to its upper end along the symmetry axis (BB') of said metallic members (14-16), the metallic members (14-16) being oriented in a direction extending from the common point (17) of said metallic members and opposite the earth plane (11);

wherein each metallic member has a curvature defining a three-dimensional profile having a curvature, on one hand, along a longitudinal axis of the metallic member and on the other hand along the direction transverse to the longitudinal axis of the metallic member.

2. The antenna according to claim 1, wherein the common point (17) of all of the metallic members (14, 15, 16) is connected to a launch probe (12) forming feed means.

3. The antenna according to claim 1, wherein the metallic members (14, 15, 16) have a rectilinear or non-rectilinear longitudinal profile (42).

4. The antenna according to claim 3, wherein each of the metallic members (14, 15, 16) has a longitudinal profile (42) in relation to the symmetry axis (AA') of the antenna chosen from the following group: straight, concave, convex or wavy.

5. The antenna according to claim 1, wherein the metallic members (14, 15, 16) each have a rectilinear or non-rectilinear transverse profile (41).

6. The antenna according to claim 5, wherein each of the metallic members (14, 15, 16) has a transverse profile (41) in relation to the symmetry axis (AA') of the antenna chosen from the following group: straight, concave, convex or wavy.

7. The antenna according to claim 1, wherein the upper end of the metallic members (14, 15, 16) has a shape chosen from the following group: straight, concave, convex or wavy.

8. The antenna according to claim 1, wherein the metallic members (14, 15, 16) are made in one piece.

9. A telecommunications device, comprising at least one omni-directional ultra-wide band monopole antenna as defined by claim 1.

10. A method for manufacturing an omni-directional ultra-wide band monopole antenna according to claim 1 comprising:

cutting out the metallic members (14, 15, 16) in one piece (52), in a single metallic sheet.

* * * * *